United States Patent [19]

Day et al.

[11] Patent Number: 4,743,226

[45] Date of Patent: May 10, 1988

[54] HIGH CAPACITY CONTINUOUS SOLID BOWL CENTRIFUGE

[75] Inventors: Roger W. Day; Charles N. Grichar, both of Houston, Tex.

[73] Assignee: Geosource Inc., Houston, Tex.

[21] Appl. No.: 490,195

[22] Filed: Apr. 29, 1983

[51] Int. Cl.[4] ..... B04B 1/20

[52] U.S. Cl. ..... 494/53

[58] Field of Search ..... 494/23, 27, 52, 53, 494/54, 55

[56] References Cited

U.S. PATENT DOCUMENTS

| | | | |
|---|---|---|---|
| 1,885,154 | 11/1932 | Strezynski | 494/27 |
| 2,578,456 | 12/1951 | Smith | 494/53 |
| 2,711,854 | 6/1955 | Kjellgren | 494/53 |
| 3,268,159 | 8/1966 | Kern . | |
| 3,795,361 | 3/1974 | Lee . | |
| 3,885,734 | 5/1975 | Lee . | |
| 3,934,792 | 1/1976 | High et al. . | |
| 4,085,888 | 4/1978 | Jager . | |
| 4,228,949 | 10/1980 | Jackson . | |
| 4,240,578 | 12/1980 | Jackson . | |
| 4,298,160 | 11/1981 | Jackson . | |
| 4,298,162 | 11/1981 | Hohne . | |
| 4,339,072 | 7/1982 | Hiller . | |
| 4,378,906 | 4/1983 | Epper et al. | 494/53 |

*Primary Examiner*—Robert W. Jenkins

*Attorney, Agent, or Firm*—Arnold, White & Durkee

[57] ABSTRACT

A high capacity continuous solid bowl centrifuge is disclosed having longitudinal vanes which cooperate with helical flights to form longitudinal channels. The longitudinal vanes may be curved vanes or they may be planar vanes disposed either radially or at an acute angle relative to a radius from the longitudinal axis of the centrifuge. In operation, the solids/liquid mixture fed into the centrifuge is separated, and the liquids move in a "plug-flow" manner in the longitudinal channels parallel to the axis of rotation, toward effluent discharge ports disposed at one end of the centrifuge. The separated heavier solids are moved by the flights toward the opposite end of the centrifuge where they exit through a solids discharge port.

12 Claims, 4 Drawing Sheets

Fig. 1A
PRIOR ART
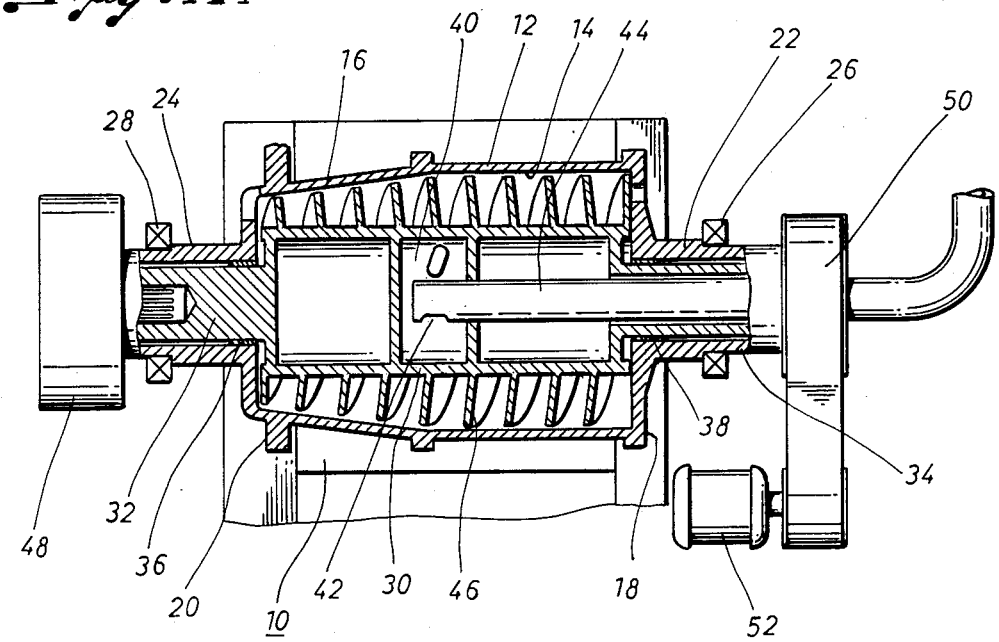
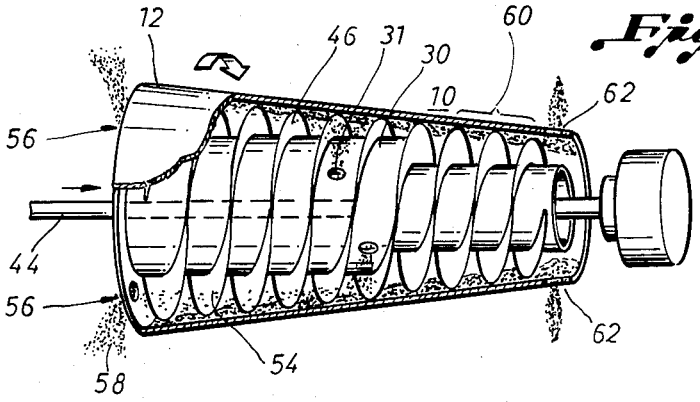
Fig. 1B
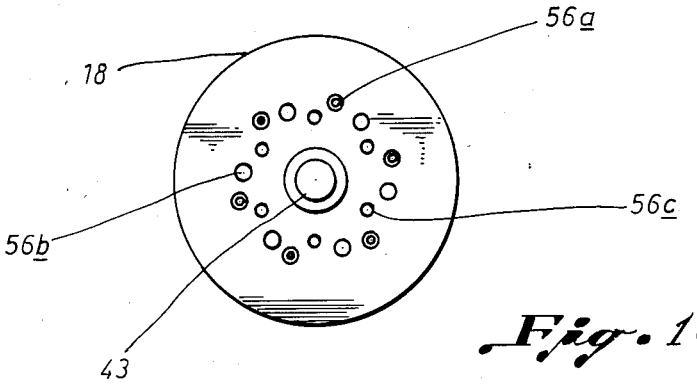
Fig. 1C

HIGH CAPACITY CONTINUOUS SOLID BOWL CENTRIFUGE

BACKGROUND OF THE INVENTION

This invention relates generally to centrifuges, and more particularly to a solid bowl decanter centrifuge.

Decanter centrifuges are well known, and usually include a rotating centrifuge bowl in which a screw conveyor revolves at a slightly different speed. Such centrifuges are capable of continuously receiving feed in the bowl and of separating the feed into layers of light and heavy phase materials which are discharged separately from the bowl. The screw conveyor structure, rotating at a differential speed with respect to the bowl, moves the outer layer of heavy phase material to a discharge port usually located in a tapered or conical end portion of the bowl. Centrifugal force tends to make the light phase material discharge through one or more ports usually located at the opposite end of the bowl.

Efficient centrifugal separation requires the light phase material be discharged containing little or no heavy phase material, and the heavy phase material be discharged containing only a small amount of light phase material. For example, if the light phase material is water and the heavy phase material soft solids, it is preferred that fairly dry solids and clean water be separately discharged.

Decanter centrifuges have many varied industrial applications. For example, they are used in the oil industry to process drilling mud to separate undesired drilling solids from the valuable liquid mud. In such applications, decanter centrifuges have the advantage of being less susceptible to pluggage by solids than other kinds of centrifuges. Additionally, decanter centrifuges may be shut down for long or short periods of time and then restarted with minimum difficulty, unlike most other centrifuges which require cleaning to remove dried solids.

There are many applications in the oil industry and elsewhere in which the decanting centrifuge must process the solids/liquid mixture at extraordinarily high feed rates. When the basic conventional design is modified to accommodate such feed rates, it has been found that high torques are encountered, the energy required to process the mixture becomes prohibitive, and the physical size of the centrifuge becomes prohibitive.

Additionally, as larger feed volumes are processed in a given centrifuge machine, the clarification capability of the centrifuge diminishes rapidly due to decreased relative settling area, partial-acceleration or nonacceleration (slippage) of the feed fluid (the solids/liquid mixture), deceleration of the fluid caused by fluid movement through the conveyor, and turbulence created by the movement of large volumes of fluid through the conventional helix of conventional conveyor flights.

Thus, there is a need for a decanter centrifuge capable of high capacity continuous operation at elevated feed rates and volumes.

SUMMARY OF THE INVENTION

According to the present invention, a high capacity continuous solid bowl centrifuge is provided which can process a solids/liquid mixture at a high feed rate with relatively low horsepower and relatively high clarification.

In one embodiment, the conveyor includes a plurality of substantially longitudinal vanes. Flights are disposed generally about the longitudinal vanes, thereby defining a plurality of longitudinal channels through which the separated liquid flows in a "plug-flow" manner essentially parallel to the axis of rotation.

According to one as of the present invention, the vanes are radially disposed relative to the longitudional axis of rotation. According to another aspect of the invention, the vanes are inclined at an acute angle relative to a radius from the longitudional axis of rotation thereby increasing the settling area and thus the centrifuge capacity of the centrifuge. According to yet another aspect of the invention, the longitudinal vanes are curved in such a manner that the angle between the curved vane and a radius from the longitudional axis of rotation is held essentially constant, thereby still further increasing the settling area of the centrifuge.

In another embodiment of the present invention, dual feed conduit structure is arranged such that lighter feed materials can be introduced into the centrifuge and directed through its vaned cylindrical section to maximize the removal of fines, and heavier feed mixtures can be introduced further into the centrifuge to reduce gearbox torque. By this arrangement, relatively heavier and lighter feed materials can be introduced at different feed rates.

BRIEF DESCRIPTION OF THE DRAWINGS

The invention will further be described by reference to the accompanying drawings wherein like members bear like reference numerals and wherein:

FIGS. 1A, 1B and 1C illustrate known decanter centrifuges;

DESCRIPTION OF THE PREFERRED EMBODIMENTS

Figure 2A:
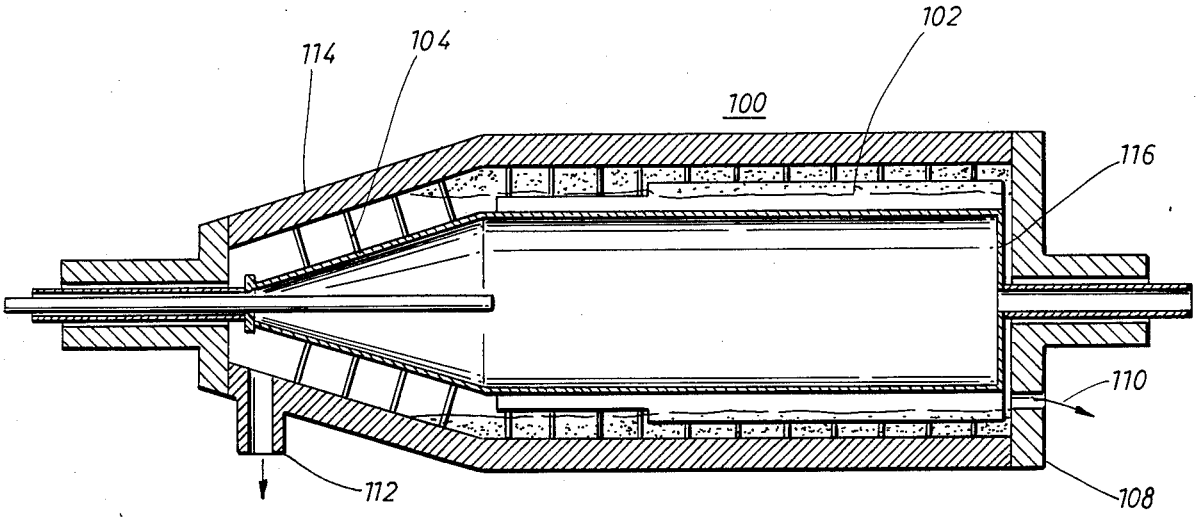
FIG. 2A is a diagramatic illustration of a solid bowl centrifuge according to the present invention.

FIG. 1 illustrates known solid bowl decanter centrifuges. Referring to FIG. 1A, a solid bowl decanter centrifuge 10 has a centrifuge bowl 12 which includes a cylindrical portion 14 and a tapered or conical portion 16 terminating in circular end plates 18 and 20, respectively. Hollow end shafts 22 and 24 project from the circular end plates 18 and 20 and are journaled in bearings 26 and 28.

A conveyor 30, having end shafts 32 and 34 journaled in bearings 36 and 38, is independently rotatable within the bowl 12. The conveyor 30 includes a central cylindrical portion having within it a chamber 40 for the reception of feed mixtures from an orifice 42 of an inlet pipe 44. The conveyor further includes a screw 46 composed of a helical flight whose contour closely follows that of the cylindrical and conical portions of the centrifuge bowl.

The end shaft 32 is driven by the output shaft of a gearbox 48, and the end shaft 34 is driven by a belt 50 and an electric motor 52. The bowl 12 is rotated at a speed slower or faster than that of the conveyor 30.

Referring now to FIGS. 1B and 1C, a conventional decanting centrifuge is illustrated in cut-away, perspective view. The solids/liquid mixture to be processed is introduced to the centrifuge 10 through an inlet 43 of the inlet pipe 44. The feed mixture is accelerated within the conveyor 30 and introduced to the separation chamber 40 by feed ports 31 located in the hub of the conveyor 30.

In operation, as the solids/liquid mixture moves into the chamber 40, it is exposed to high gravity forces produced by the rotating assembly. Under these forces, the feed mixture spreads against the inner surface of the bowl 12 forming a liquid layer or pool having a pool level 54.

The lighter, free-liquid and finer solids move toward the larger end of the centrifuge and exit through overflow ports 56 as a colloidal-liquid discharge 58. The overflow ports 56 are located on the end plate 18, best illustrated in FIG. 1C. The pool level 54 is controlled by adjusting the position of the overflow ports 56. Ports **56*a* provide for a shallow pool level, ports 56*b* provide for a medium pool level, and ports 56c** provide for a deep pool level.

As the lighter phase material moves toward the larger end of the centrifuge, the heavier, coarser solids settle against the inner wall of the bowl 12 and are moved toward the conical end of the bowl by the helical flights 46 carried on the conveyor 30. The conveyor flights push the solids up an inclined drainage beach 60 where they are dewatered, and concentrated solids containing only adsorbed liquid exits the centrifuge through solids discharge ports 62. The differential speed between the bowl 12 and the conveyor 30 creates the motion necessary to convey the settled solids.

The apparatus thus far described is already known, as is its method and mode of operation.

Referring now to FIGS. 2–5, and in particular to FIG. 2A, there is shown in diagramatic form a centrifuge 100 according to the present invention having a plurality of longitudinally disposed radial vanes 102. Wrapped around the vanes 102 are flights 104 which are step-wise reduced in size from the solids end of the centrifuge to the effluent end, as best illustrated in FIG. 4A. The vanes 102 and the flights 104 cooperate to define longitudinal channels 106, best illustrated in FIG. 4B.

In operation, the liquid moves longitudinally through the channels 106 toward the effluent discharge end 108 of the centrifuge 100 where effluent discharge 110 occurs. The solids are moved toward one or more solids discharge ports 112 (only one of which is illustrated) by the flights 104 utilizing the differential rotation between the bowl 114 and the conveyor 116.

Figure 2B:
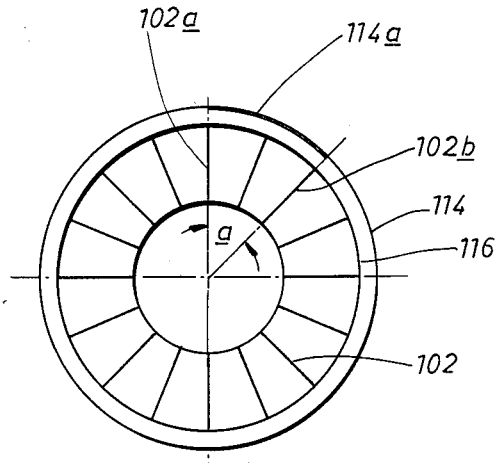
FIG. 2B is a diagramatic illustration of the radial vane structure of the centrifuge illustrated in FIG. 2A as viewed from the effluent discharge end.

In the embodiment illustrated in FIGS. 2A, 2B, 4A and 4B, the longitudinal vanes 102 are radial, that is, they are disposed along radii from the longitudinal axis of rotation of the centrifuge. With such a configuration, the settling area as illustrated in FIG. 2B in an angular section a located between vanes **102*a* and 102*b* is related to the surface area 114*a* of the inner wall of the bowl 114**. The settling area can be increased, thereby enhancing the settling ability or centrifuge capability of the centrifuge, by altering the vane structure.

Figure 3A:
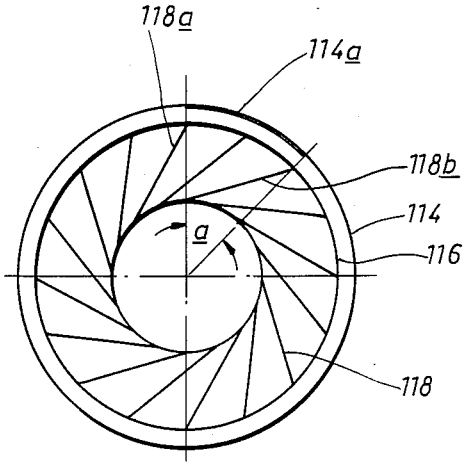
FIGS. 3A and 3B are diagramatic illustrations of inclined and curved longitudinal vane structures according to the present invention.

FIG. 3A illustrates an alternate embodiment in which inclined longitudinal vanes **118*a* and 118*b* are each disposed at an acute angle relative to a radius from the longitudinal axis of the centrifuge. The settling area in the angular section a located between vanes 118*a* and 118*b* is related to the surface area 114*a* of the inner wall of the bowl 114** and the inner surface area located in the angular section a of the inclined vanes.

Figure 3B:
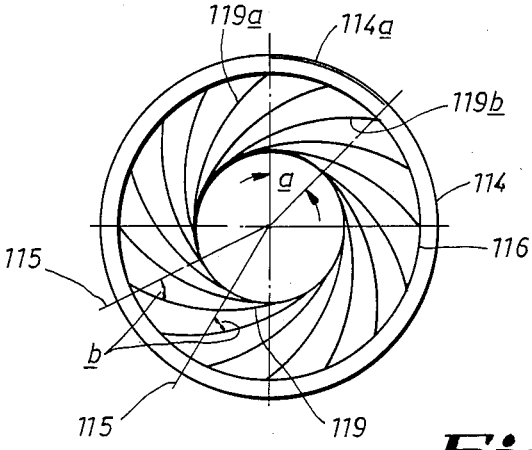
Figures 4A, 4B:
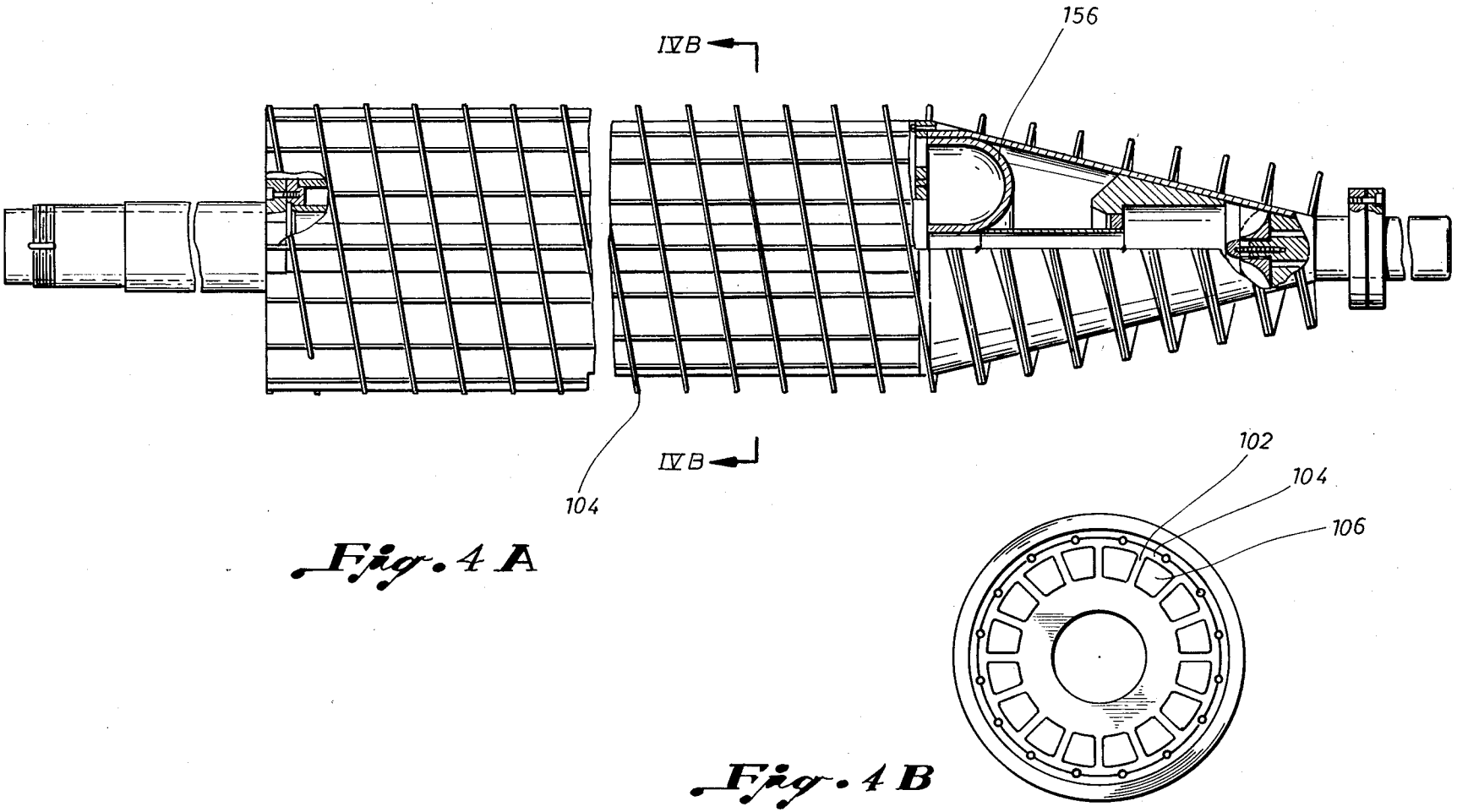
FIGS. 4A and 4B are diagramatic illustrations of a conveyor according to the present invention.

FIG. 3B illustrates another alternate embodiment having curved vanes **119*a* and 119*b*. The contour of the curve is chosen such that a constant acute angle b is maintained between a radius 115 from the longitudional axis of the conveyor 116 and the curved longitudinal vane 119. In the illustrated embodiment, the settling area in the angular section a located between the curved longitudinal vanes 119*a* and 119*b* is related to the surface area 114*a* of the inner wall of the bowl 114** and the inner surface area located in the angular section a of the curved vanes.

The magnitude of the acute angle between a radius from the longitudinal axis of the centrifuge and either an inclined vane or a curved vane is generally less than that of the angle of repose of the solids material being processed. The curved vane configuration in which the magnitude of the acute angle is held essentially constant along the length of the vane, permits this angular condition to be maintained while maximizing the settling area of the vane structure.

It has been found, that the inclined lontitudinal vane structure illustrated in FIG. 3A produces a settling area approximately twice that produced by the radial longitudinal vane structure illustrated in FIG. 2B. Moreover, the curved longitudinal vane structure illustrated in FIG. 3B produces a settling surface area approximately four times that of the radial longitudinal vane structure illustrated in FIG. 2B.

The present invention permits the liquid pool within the rotating bowl to be deeper, reducing the horsepower needed to drive the centrifuge. Deepening the pool in conventional centrifuges, however, reduces the settling area available for liquid clarification. But the additional surface area contributed by the longitudinal vanes of the present invention not only restores the settling area lost by deepening the pool, but increases it above that of conventional centrifuges of similar size.

Yet further, the settling area of the present centrifuge can be increased dramatically by adding a greater number of longitudinal vanes. This allows the settling area to be increased while maintaining the same length and diameter bowl. In conventional centrifuges, the settling area is increased by making the bowl longer and/or larger in diameter, which results in a physically larger machine.

The longitudinal vane design increases the separation efficiency of the centrifuge when compared to conventional centrifuges of similar size. The increased efficiency is primarily due to the increased settling area and the fact that the liquid flows in a "plug-flow" manner, parallel to the axis of rotation, rather than in a "turbulent-flow" about the helical screw of conventional centrifuges.

The longitudinal vanes can act as accelerators that tend to bring and hold the solids/liquid mixture up to the speed of the bowl before the mixture is introduced into the separation chamber. This greatly eliminates slippage. Acceleration may be further enhanced by structure illustrated in FIG. 5.

Figure 5:
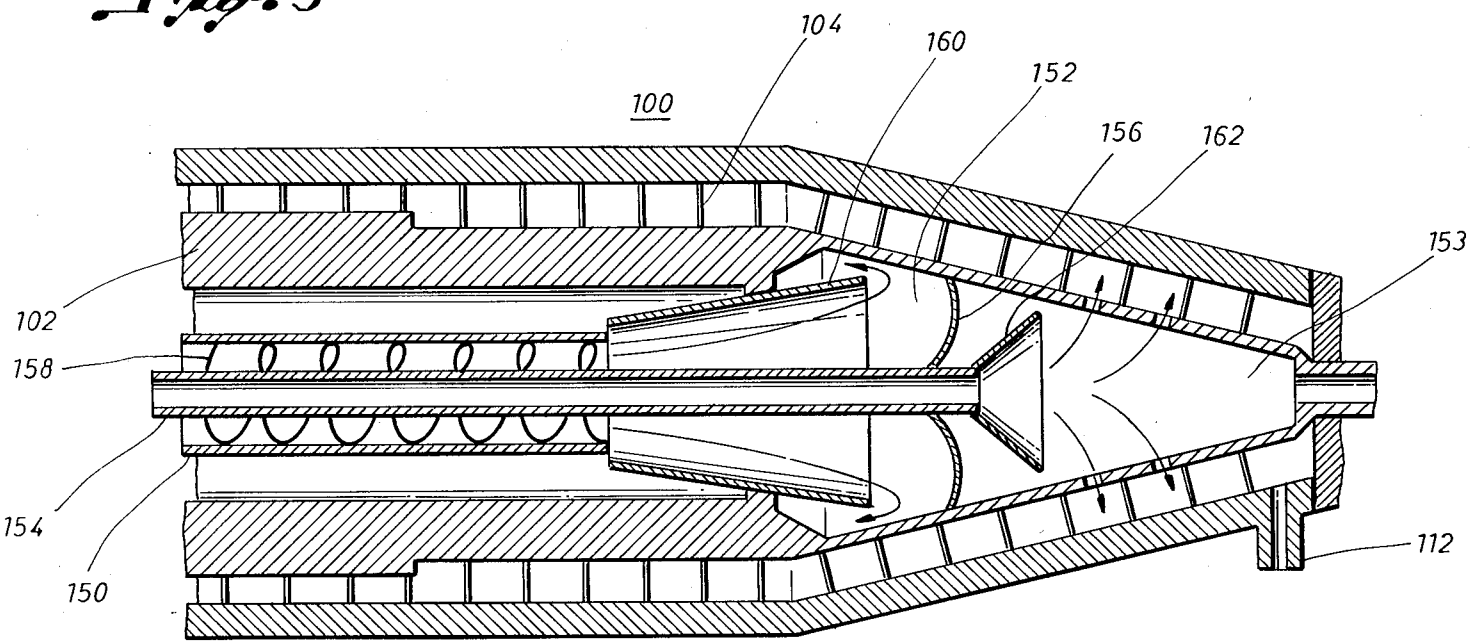
FIG. 5 is a diagramatic illustration of an alternate embodiment of the centrifuge illustrated in FIG. 2A.

Referring now to FIG. 5, an alternate embodiment of a high capacity centrifuge according to the present invention is illustrated having dual feed structure. The dual feed structure includes a light fluid feed pipe 150 concentric with the axis of rotation of the conveyor, and extending into an accelerating space or chamber 152. A heavy fluid feed pipe 154 disposed coaxial with respect to the pipe 150 extends into another accelerating space or chamber 153. The pipes 150 and 154 are arranged to introduce the heavier solids/liquid mixture further into the machine than the lighter solids/liquid mixture. The heavier mixture, because of its weight, is more easily separated, and its introduction further into the machine reduces the resultant gearbox torque.

The lighter solids/liquid mixture introduced by the pipe 150 can be introduced at a very high feed rate. The lighter fluid is directed by a fluid guidance system 156 through the vaned cylindrical section of the machine to maximize the removal of fines.

With continued reference to FIG. 5, a spiral preaccelerator 158 is located within the bore of the light fluid feed pipe 150. A conical fluid accelerator 160 is disposed proximate the end of the feed pipe 150 and extends into the accelerating chamber 152. A second conical fluid accelerator 162 is disposed proximate the end of the heavy fluid feed pipe 154, and extends into the accelerating chamber 153. The fluid guidance system 156 is disposed intermediate the fluid accelerators 160 and 162 and separates the accelerating chambers 152 and 153 from each other. The accelerators 158, 160 and 162 are optional and in many applications may be eliminated in whole or in part.

The principles, preferred embodiments, and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

What is claimed is:

1. A solid bowl centrifuge for separating a solids/liquid mixture having a solids end and an effluent end, said centrifuge comprising:

conveyor structure adapted to rotate at a differential speed with respect to the bowl, said conveyor structure including:

a plurality of substantially longitudinal vanes each having first and second ends, said longitudinal vanes being increased in size form the solids end to the effluent end of said centrifuge, and said second ends being disposed proximate said effluent end; and helical flight structure disposed generally about said plurality of substantially longitudinal vances, said flight structure including flights reduced in size from the solids end to the effluent end of the centrifuge, said flight structure and said vanes cooperating to define a plurality of substantially longitudinal channels.

2. A solid bowl centrifuge for separating a solids/liquid mixture having a solids end and an effluent end, said centrifuge comprising:

conveyor structure adapted to rotate at a differential speed with respect to the bowl, said conveyor structure including:

a plurality of substanitally longitudinal vanes, said longitudinal vanes being increased in size from the solids end to the effluent end of said centrifuge; and helical flight structure disposed generally about said plurality of substantially longitudinal vanes, said flight structure including flights reduced in size from the solids end to the effluent end of the centrifuge, said flight structure and said vanes cooperating to define a plurality of substantially longitudinal channels;

wherein said centrifuge includes a cylindrical portion;

wherein said longitudinal vanes are disposed substantially in said cylindrical portion of said centrifuge; and further wherein said longitudinal vanes are increased in size and said flights are reduced in size in said cylindrical portion of said centrifuge.

3. The solid centrifuge of claim 2, wherein said longitudinal vanes are each substantially planar.

4. The soldi bowl centrifuge of claim 3, wherein at least one of said longitudinal vanes is radially disposed relative to the longitudinal axis of the conveyor structure.

5. The solid bowl centrifuge of claim 3, wherein at least one of said longitudinal vanes is disposed at an acute angle relative to a radius from the longitudinal axis of the conveyor structure.

6. The solid bowl centrifuge of claim 2, whrein said longitudinal vanes are each substantially curved.

7. The solid bowl centrifuge of claim 6, wherein at least one of said curved longitudinal vanes is disposed at a constant acute angle relative to a radius from the longitudinal axis of the conveyor structure.

8. A solid bowl centrifuge for separating a solids/liquid mixture having a solids end and an effluent end, said centrifuge comprising:

a bowl having a cylindrical portion;

fluid guidance structure;

conveyor structure having a cylindrical portion disposed proximate the cylindrical portion of said bowl, having a plurality of substantially longitudinal vanes and a flight structure and wherein said vanes and said flight structure cooperate to define a plurality of substantially longitudinal channels, said conveyor structure being adapted to rotate at a differential speed with respect to the bowl, said conveyor structure and said bowl cooperating to define an accelerating chamber, and said accelerating chamber having first and second regions separated by said fluid guidance structure, said second region being located nearer said solids end than said first region, and said first region being located nearer said effluent end than said second region; and feed structure adapted to introduce the solids/liquid mixture into said accelerating chamber, said feed structure including:

first feed structure adapted to introduce a relatively light solids/liquid mixture into said first region of said accelerating chamber; and second feed structure adapted to introduce a relatively heavy solids/liquid mixture into said second region of said accelerating chamber.

9. The solid bowl centrifuge of claim 8, wherein:

said first feed structure includes a first cylindrical conduit having a first diameter; and said second feed structure includes a second cylindrical conduit having a diameter smaller than said first diameter, said first and second cylindrical conduits being substantially coaxially disposed.

10. The solid bowl centrifuge of claim 9, wherein said feed structure further includes:

spiral pre-accelerating structure disposed in the bore of said first cylindrical conduit; and conical accelerator structure longitudinally disposed in said accelerating chamber proximate at least one of said first and second cylindrical conduits.

11. The solid bowl centrifuge of claim 9, wherein said feed structure further includes:

a first conical accelerator longitudinally disposed in said first region of said accelerating chamber proximate said first cylindrical conduit; and a second conical accelerator longitudinally disposed in said second region of said accelerating chamber proximate said second cylindrical conduit.

12. A solid bowl centrifuge for separating a solids/-liquid mixture having a solids end and an effluent end, said centrifuge comprising:

a bowl having a cylindrical portion;

conveyor structure adapted to rotate at a different speed with respect to the bowl, said conveyor structure and said bowl cooperating to define an accelerating chamber, and said conveyor structure including:

a cylindrical portion disposed substantially in the cylindrical portion of said bowl;

a plurality of substantially longitudinal vanes, said vanes being step-wise increased in size in said cylindricla portion of the conveyor structure from the solids end to the effluent end of said centrifuge; and helical flight structure disposed generally about said plurality of substantially longitudinal vanes, said flight structure including flights step-wise reduced in size in said cylindrical portion of the conveyor structure from the solids end to the effluent end of the centrifuge, said flight structure and said vanes cooperating to define a plurality of substantially longitudinal channels;

a feed structure adpated to introduce the solids/liquid mixture into the accelerating chamber, said feed structure including:

a first cylindrical conduit having a first diameter;

a second cylindrical conduit having a diameter smaller than said first diameter;

first accelerator structure disposed in the accelerating chamber proximate the first cylindrical conduit;

second accelerator structure disposed in the accelerating chamber proximate the second cylindrical conduit; and fluid guidance structure disposed in the accelerating chamber intermediate said first and second accelerator structures.

* * * * *